US007641125B2

(12) United States Patent
Rimmer et al.

(10) Patent No.: US 7,641,125 B2
(45) Date of Patent: Jan. 5, 2010

(54) VARIABLE AIR VOLUME CEILING DIFFUSER

(75) Inventors: Julian Douglas Tyldesley Rimmer, Winnipeg (CA); Richard James Steinburg, Winnipeg (CA); Nabil Sabet, Winnipeg (CA); Davis John Dyck, Winnipeg (CA); Andrew Garth McCorrister, Winnipeg (CA); Alfred Theodor Dyck, Winnipeg (CA); Jerry M. Sipes, Suwanee, GA (US)

(73) Assignee: E.H. Price Ltd., Winnipeg (CA)

( * ) Notice: Subject to any disclaimer, the term of this patent is extended or adjusted under 35 U.S.C. 154(b) by 615 days.

(21) Appl. No.: 11/294,639

(22) Filed: Dec. 5, 2005

(65) Prior Publication Data

US 2006/0243814 A1 Nov. 2, 2006

Related U.S. Application Data

(60) Provisional application No. 60/676,697, filed on Apr. 29, 2005.

(51) Int. Cl.
*F24F 7/00* (2006.01)
*F24F 13/08* (2006.01)

(52) U.S. Cl. ..... 236/49.3; 236/49.5; 454/354

(58) Field of Classification Search ..... 236/49.1, 236/49.3, 49.5; 454/354, 363, 362
See application file for complete search history.

(56) References Cited

U.S. PATENT DOCUMENTS 3,327,606 A 6/1967 Little et al.
3,807,537 A * 4/1974 O'Reilly ..... 190/121
RE30,953 E 6/1982 Vance et al.
4,491,270 A * 1/1985 Brand ..... 236/49.5
4,509,678 A 4/1985 Noll
4,515,069 A 5/1985 Kline et al.
4,523,713 A * 6/1985 Kline et al. ..... 236/1 C
4,537,347 A 8/1985 Noll et al.
4,549,474 A 10/1985 Fey et al.
4,821,955 A 4/1989 Kline et al.
4,966,067 A * 10/1990 Ames et al. ..... 92/150
5,016,525 A 5/1991 Weck
5,052,284 A 10/1991 Schweikert
5,054,379 A 10/1991 Sodec
5,058,490 A 10/1991 Sodec et al.
5,069,114 A 12/1991 Sodec et al.

(Continued)

FOREIGN PATENT DOCUMENTS

CA 2418187 8/2003

*Primary Examiner*—Chen-Wen Jiang
(74) *Attorney, Agent, or Firm*—Smith, Gambrell & Russell

(57) ABSTRACT

A variable air volume ceiling diffuser includes a damper that is raised and lowered by a linkage that is controlled by a duct temperature sensor/actuator and one or more room temperature sensors/actuators. The linkage includes a heating slide movable for the heating mode and a cooling slide movable for the cooling mode. The duct temperature sensor/actuator selects the heating slide for movement by the room temperature sensors/actuators in the heating mode and selects the cooling slide for movement by the room temperature sensors/actuators in the cooling mode. The differential movement between the heating and cooling slides moves a roller that engages a profiled cam surface attached to two lever arms. As the roller moves along the cam surface, the lever arms pivot about their axis of rotation so that the damper moves upward to close the air inlet and downward to open the air inlet.

20 Claims, 12 Drawing Sheets

U.S. PATENT DOCUMENTS 5,297,326 A 3/1994 Kline
5,340,358 A 8/1994 Halupczok et al.
5,360,373 A 11/1994 Makulla et al.
5,366,149 A 11/1994 Kline
5,551,915 A 9/1996 Schweikert
5,556,330 A 9/1996 Schweikert
5,647,532 A 7/1997 de Villiers et al.
5,673,851 A 10/1997 Dozier
5,860,592 A 1/1999 Dozier et al.
5,938,525 A 8/1999 Birdsong et al.
6,050,892 A 4/2000 Sodec
6,083,100 A 7/2000 Hardy et al.
6,176,435 B1 1/2001 Nielsen
6,220,518 B1 4/2001 Kline et al.
6,231,438 B1 5/2001 Laudermilk
6,241,156 B1 6/2001 Kline et al.
6,250,560 B1 6/2001 Kline et al.
6,254,010 B1 7/2001 De Villiers
6,290,596 B1 9/2001 Birdsong et al.
6,338,437 B1 1/2002 Kline et al.
6,361,432 B1 3/2002 Walker
6,544,117 B1 4/2003 Hardy
6,581,847 B2 6/2003 Kline et al.
6,736,326 B2 * 5/2004 Hunka ..... 236/1 C
6,857,577 B2 2/2005 Hunka
2003/0146291 A1 8/2003 Hunka

* cited by examiner

Fig. 1
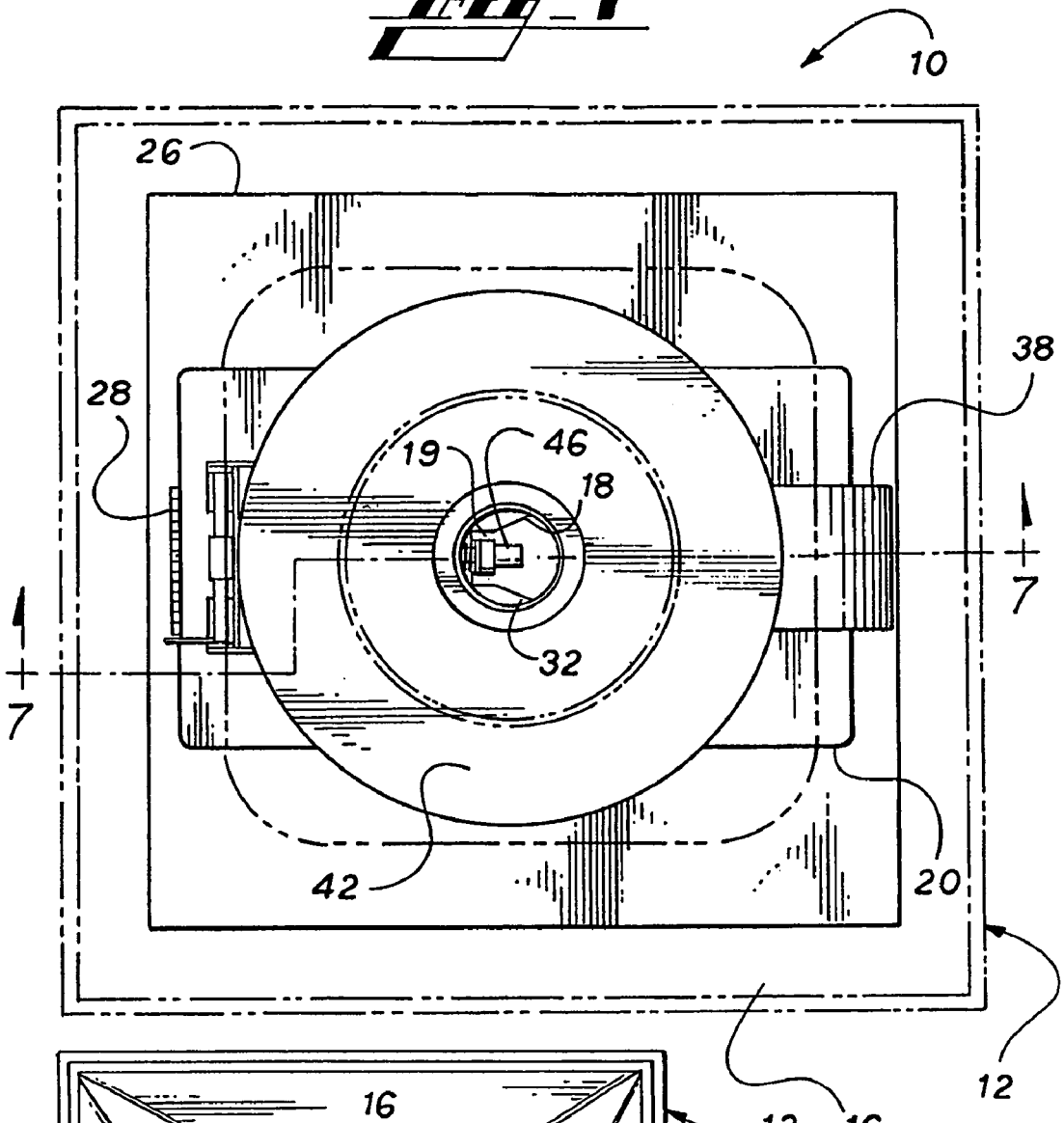
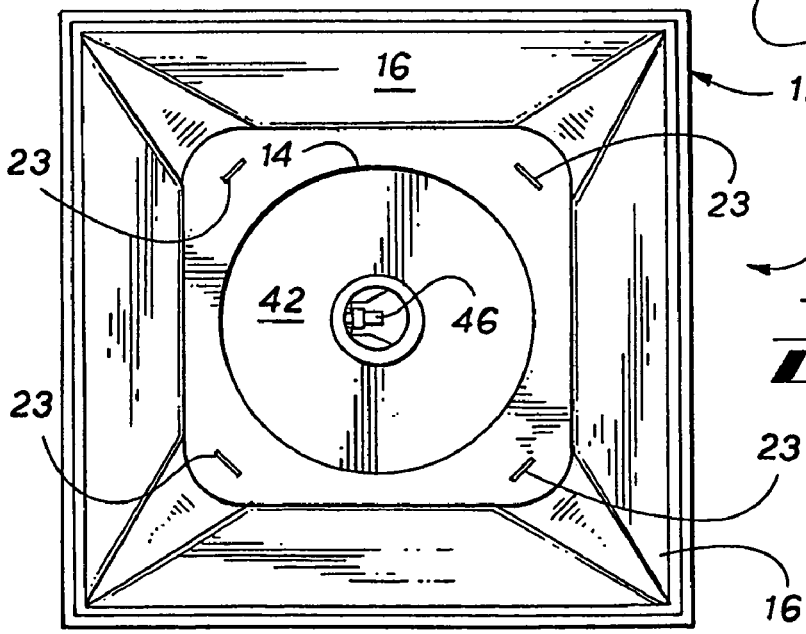
Fig. 2

VARIABLE AIR VOLUME CEILING DIFFUSER

CROSS REFERENCE TO RELATED APPLICATION

This application claims priority under 35 U.S.C. § 119(e) to U.S. Provisional Patent Application Ser. No. 60/676,697, filed in of the United States Patent and Trademark Office on Apr. 29, 2005, the disclosure of which is hereby incorporated by reference.

FIELD OF THE INVENTION

This invention relates to variable air volume (VAV) ceiling diffusers and more particularly to a thermally powered VAV ceiling diffuser.

BACKGROUND OF THE INVENTION

Thermal powered VAV ceiling diffusers are widely used in HVAC systems to control the temperature within an occupied space. The VAV ceiling diffuser is connected to a heating and cooling duct of the HVAC system. The heating and cooling duct supplies either warm or cool air to the diffuser. The diffuser has thermal sensors/actuators that sense the temperature of the air supplied in the duct and the temperature of the occupied space. Based on the sensed temperatures, the thermal sensors/actuators drive a linkage that opens and closes a damper to increase or decrease the amount of heating or cooling air supplied to the occupied space in order to maintain a relatively constant temperature in the occupied space.

The prior art discloses a number of thermal powered VAV ceiling diffusers that employ various linkages for controlling the movement of the damper in response to the duct temperature and the room temperature. Because the sensors/actuators provide limited movement, the linkages must be able to translate that limited movement into accurate positioning for the damper in order to control the temperature in the occupied space.

SUMMARY OF THE INVENTION

In order to control the temperature within the occupied space accurately, the thermal powered VAV ceiling diffuser of the present invention incorporates a number of features that enhance the accuracy of the temperature control. The ceiling diffuser of the present invention is mounted in the ceiling of the occupied space and is connected to an HVAC duct that supplies warm or cool air to the inlet of the diffuser. The diffuser controls the temperature within the occupied space by controlling the amount of heating or cooling air passing through the inlet and into the occupied space from the HVAC duct. The diffuser includes a diffuser hood from which a base plate is suspended. The diffuser has a circular damper stack mounted on the base plate of the diffuser and a damper with a circular opening that slides vertically on the damper stack between an upper closed inlet position and a lower open inlet position. The damper is raised and lowered by a linkage that is controlled by a duct temperature sensor/actuator and one or more room temperature sensors/actuators.

The linkage includes two horizontal slides, a heating slide movable for the heating mode and a cooling slide movable for the cooling mode. The horizontal movements of the heating and cooling slides are controlled by the duct temperature sensor/actuator and the one or more room temperature sensors/actuators. The differential movement between the heating and cooling slides moves a roller that engages a profiled cam surface attached to two lever arms. One end of each of the lever arms is pivotally mounted at one end of the base plate for rotation about an axis, and the other end of each of the lever arms engages the bottom of the damper. As the roller moves along the cam surface, the lever arms pivot about their axis of rotation so that the damper moves upward to close the air inlet and downward to open the air inlet.

By reducing the friction in the linkage and the loading on the linkage, temperature control accuracy is enhanced. In order to reduce the load on the linkage required to move the damper up and down, the lever arms are spring loaded to offset the weight of the damper. In addition, in one embodiment of the invention, the damper stack and the opening in the damper are circular so that the damper can rotate about the damper stack thereby reducing binding between the damper stack and the damper. Temperature control accuracy is further enhanced by means of the roller and profiled cam surface that together accurately translate the differential sliding movement of the heating and cooling slides into an accurate rotational movement of the lever arms.

In operation, the duct temperature sensor/actuator senses the temperature of the air in the duct and activates the heating mode slide when the duct temperature is warm and activates the cooling mode slide when the duct temperature is cool. In the heating mode, the duct temperature sensor/actuator holds the cooling slide stationery while the two room temperature sensors/actuators control the movement of the heating slide by means of a heating set point knob attached to the two room temperature sensors/actuators. The differential movement between the stationary cooling slide and the movable heating slide controls the roller that engages the profiled cam surface attached to the two lever arms. The movement of the two lever arms raises and lowers the damper to control the flow of warm air through the diffuser.

In the cooling mode, the duct temperature sensor/actuator holds the heating slide stationery while the two room temperature sensors/actuators control the movement of the cooling slide by means of a cooling set point knob attached to the two room temperature sensors/actuators. The differential movement between the stationary heating slide and the movable cooling slide controls the roller that engages the profiled cam surface attached to the two lever arms. The movement of the two lever arms raises and lowers the damper to control the flow of cool air through the diffuser. The set point knobs are independently adjustable to set the heating temperature and the cooling temperature in the occupied space.

The diffuser of the present invention further has a single means for setting the minimum flow rate as well as setting the fully open damper position for HVAC system balancing. Raising and lowering the axis of rotation of the lever arms controls the minimum flow rate and the fully opened position of the damper.

In order to gain access to adjust the minimum flow rate, the fully open damper position, and the heating and cooling set points, the diffuser has a plaque that is hinged on one side to the base plate so that the plaque can swing away from the base plate of the diffuser. The other side of the plaque is latched to the base plate by means of rare earth magnets that hold the plaque in its closed position.

BRIEF DESCRIPTION OF THE DRAWINGS

FIG. 1 is a top plan view of the variable air volume ceiling diffuser with a movable damper in accordance with the present invention.

FIG. 2 is a top plan view of the diffuser backing hood of the variable air volume ceiling diffuser in accordance with the present invention.

DETAILED DESCRIPTION OF THE PREFERRED EMBODIMENT

Figure 3:
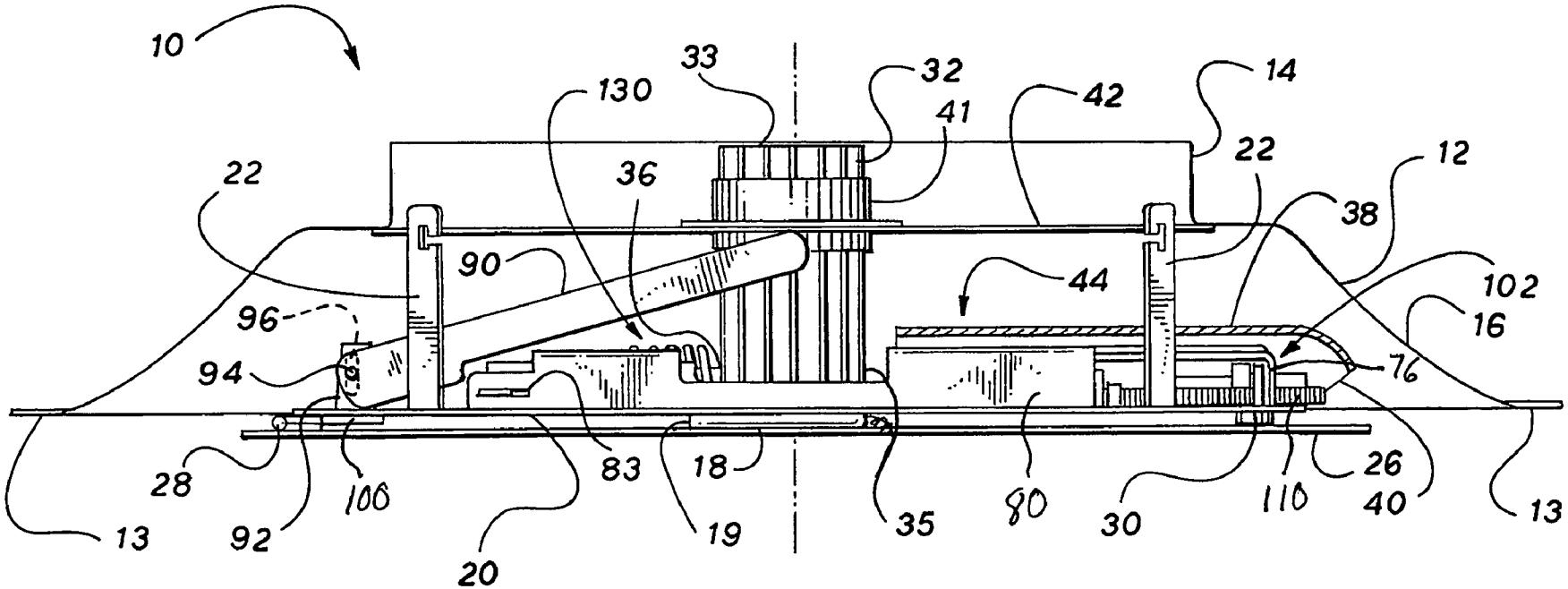
FIG. 3 is a side elevation view of the variable air volume ceiling diffuser with a movable damper in accordance with the present invention.

Referring now to the drawings, in which like reference numerals represent like parts throughout the several views, FIG. 1 shows a variable air volume (VAV) ceiling diffuser 10. The diffuser 10 comprises a diffuser hood 12, a base plate 20 hung from the hood 12 by means of base plate hangers 22 (FIG. 3) and hanger slots 23 (FIG. 2), a cylindrical damper stack 32 supported by the base plate 20, a damper 42 slideably and rotatably supported on the damper stack 32, a supply temperature actuator 46, a first room temperature actuator 60, a second room temperature actuator 70, and a damper control linkage 44 (FIGS. 3, 7*a*, and 7*b*) for controlling the movement of the damper 42 along the height of the damper stack 32.

Figure 4:
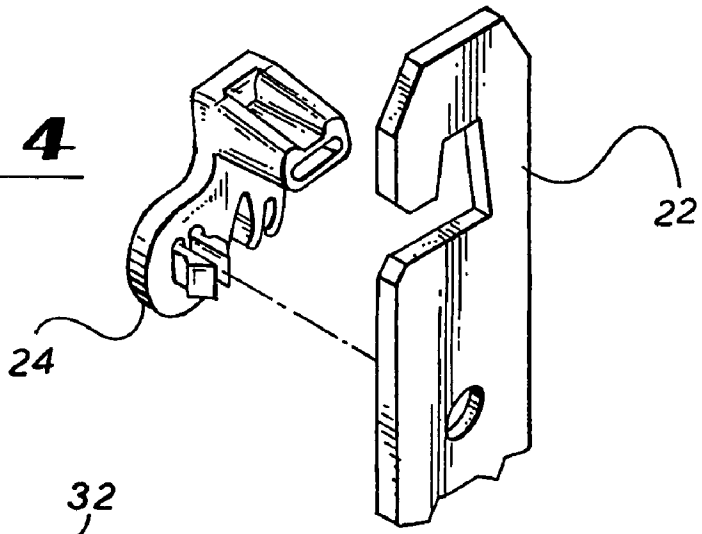
FIG. 4 is a detailed view of the base plate hangers and hanger locks of the variable air volume ceiling diffuser in accordance with the present invention.
Figure 5:
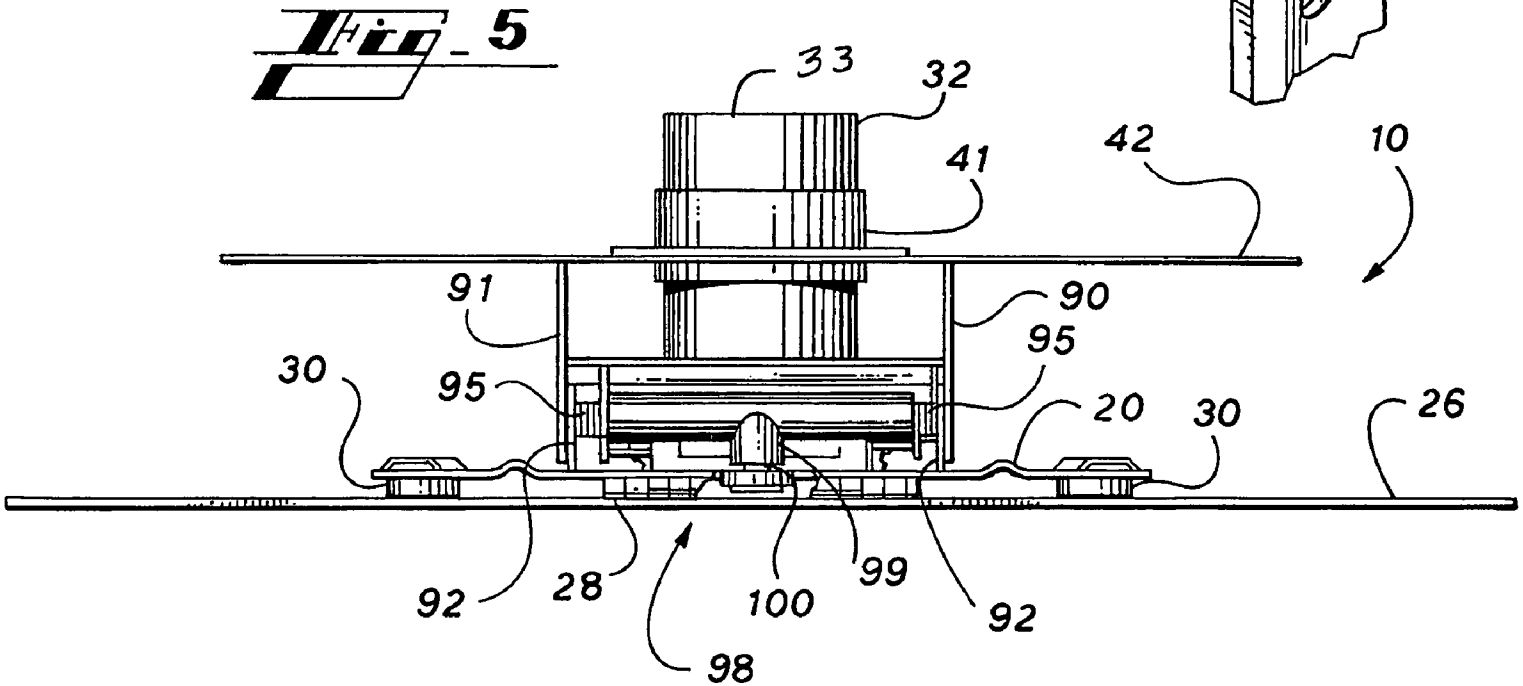
FIG. 5 is an end elevation view of the variable air volume ceiling diffuser and showing the fully open and minimum air adjustment mechanism in accordance with the present invention.

As shown in FIG. 4, the base plate hanger 22 has a hanger lock 24 that, when closed, locks the base plate hanger 22 into the hanger slot 23 of the diffuser hood 12. As shown in FIGS. 3 and 5, a plaque 26 is connected to the base plate 20 by means of a plaque hinge 28 at one end and a plaque latch 30 at the opposite end. The plaque latch 30 comprises two rare earth magnets.

As best shown in FIG. 3, the diffuser hood 12 includes a short air inlet 14 and a flared air outlet 16. The air inlet 14 is connected to an air duct for receiving warm or cool air supplied by an HVAC system. The diffuser hood 12 also has a relief 13 at the flared air outlet 16 that interfaces with a ceiling system of an occupied space.

The damper 42, shown in FIGS. 3, 5, 7*a*, and 7*b*, is slidably mounted on the damper stack 32 by means of a damper bushing 41. The damper stack 32 and the damper bushing 41 are circular in cross-section so that the damper 42 can rotate freely about the damper stack 32 as the damper 42 slides up and down, thereby reducing the chances of the damper 42 binding as it slides on the damper stack 32. The damper 42 slides vertically along the damper stack 32 in response to changes in room air temperature and supply air temperature as will be more fully explained below. When the damper 42 is in the upper position and in contact with air inlet 14, the damper 42 shuts off the flow of air through the diffuser 10 to the occupied space except for a small amount of air flowing through the damper stack 32. As the damper 42 travels downwardly and away from contact with the air inlet 14, the damper 42 allows proportionately more air through the diffuser 10 into the occupied space.

Figure 7A:
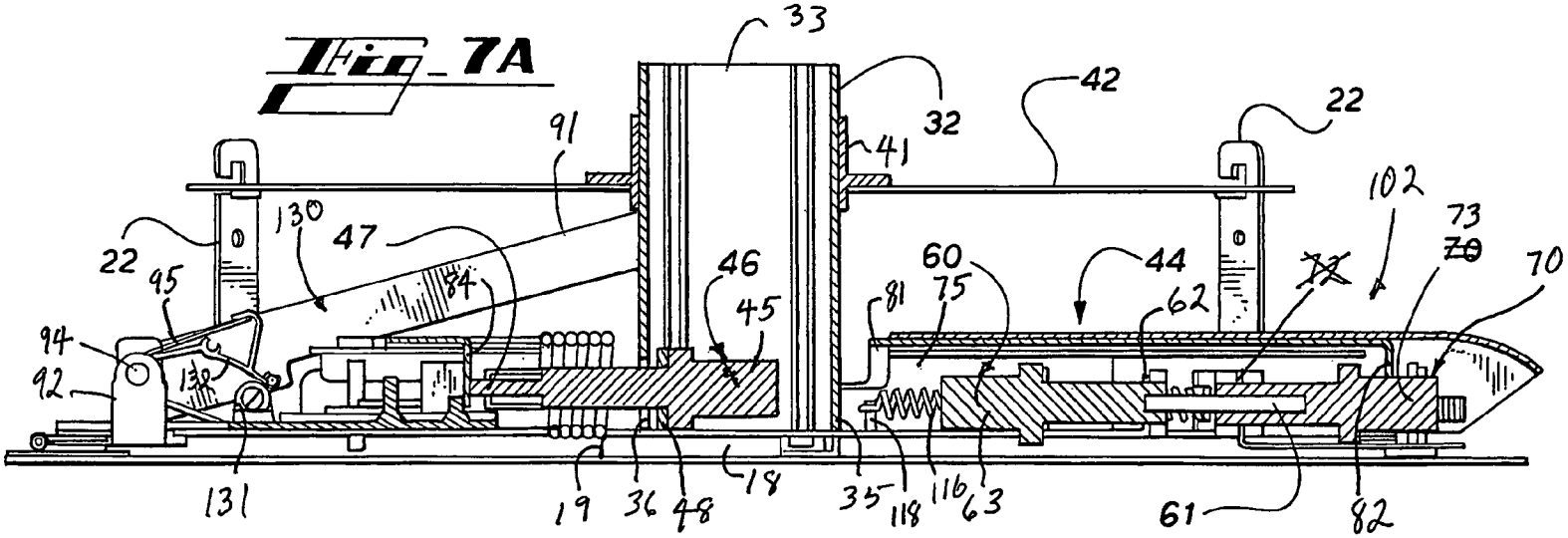
FIG. 7*a* is a section view of the ceiling diffuser taken along section line 7-7 of FIG. 1 and showing the linkage for controlling movement of the damper (heating mode, damper closed) in accordance with the present invention.
Figure 7B:
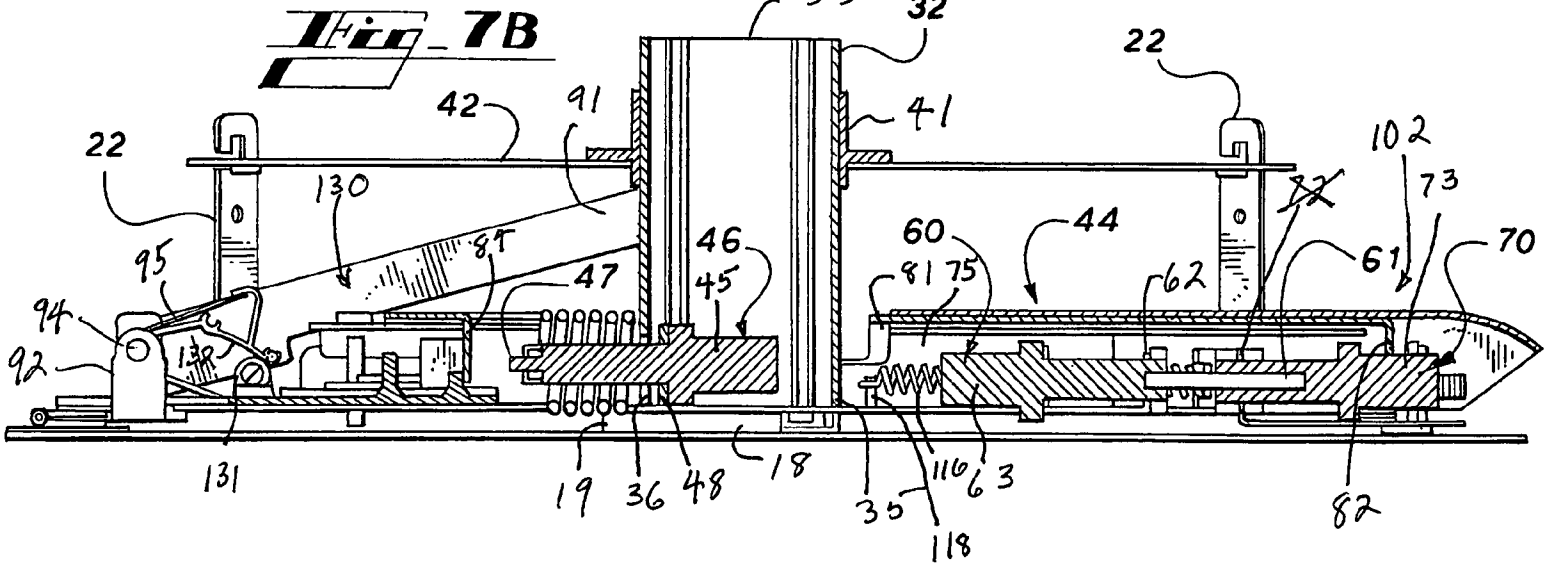
FIG. 7*b* is a section view of the ceiling diffuser taken along section line 7-7 of FIG. 1 and showing the linkage for controlling movement of the damper (cooling mode, damper closed) in accordance with the present invention.

With continuing reference to FIGS. 3, 7*a*, and 7*b*, the cylindrical damper stack 32 is mounted on the base plate 20 and protrudes upwardly into the center of the air inlet section 14. The damper stack 32 has an upper opening 33 that receives warm or cool air from the air duct and a lower end 35 that is covered by a converging deflector 18 (FIG. 11) connected to the base plate 20. The converging deflector 18 has a restricted discharge opening 19 (FIGS. 3, 7*a*, 7*b*, and 11). The damper stack 32 further has a keyhole opening 36 adjacent the lower end 35 of the damper stack 32. The supply temperature actuator 46, which has a supply temperature actuator body 45 and a supply temperature actuator piston 47 (FIGS. 7*a*, 7*b*, 8*a*, 8*b*, 9*a*, and 9*b*), is mounted on the base plate 20 by means of a supply temperature bracket 48 connected to the body at 45 of supply temperature actuator 46. The supply temperature actuator 46 extends through the keyhole opening 36, and the body 45 of the supply temperature actuator 46 is exposed the warm or cool supply air that enters the damper stack 32 through the upper opening 33.

The piston 47 of the supply temperature actuator 46 is biased to a retracted position by means of a compression supply temperature bias spring 52. A first end 53 (left in FIGS. 8*a*, 8*b*, 9*a*, and 9*b*) of the bias spring 52 is constrained by tab 55 fixed to the body 45 of the supply temperature actuator 46. A second end 54 (right in FIGS. 8*a*, 8*b*, 9*a*, and 9*b*) of the spring 52 engages a second end 51 of a spring keeper 49. A first end 50 (left in FIGS. 8*a*, 8*b*, 9*a*, and 9*b*) of the spring keeper 49 is connected to the piston 47 of the supply temperature actuator 46. The compression bias spring 52 serves to return the piston 47 of the actuator 46 to its retracted position when cool supply air is present within the damper stack 32. When warm air is present in the damper stack 32, the piston 47 of the supply temperature actuator 46 extends against the spring force of the bias spring 52 and compresses the bias spring 52.

Figure 10:
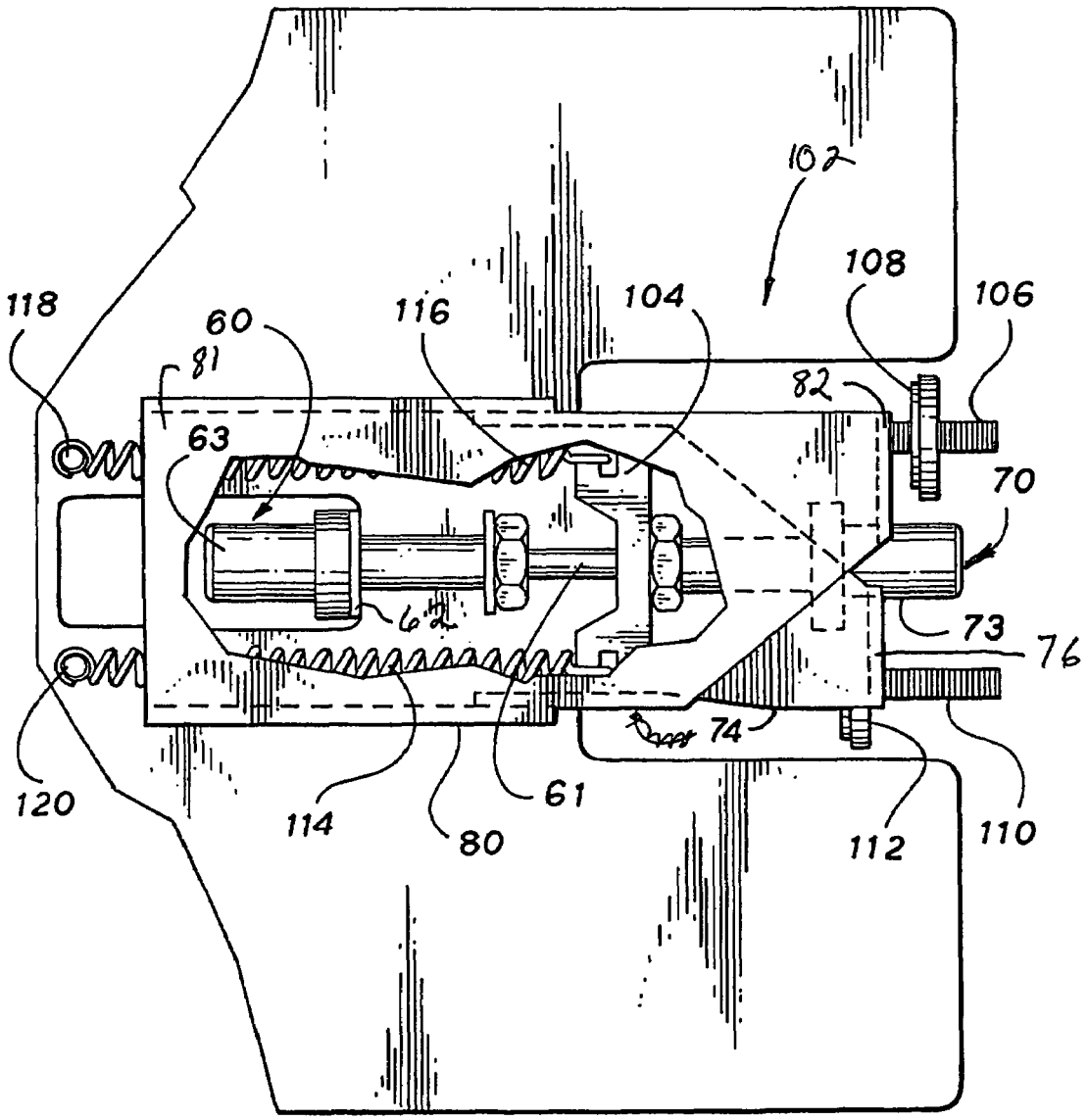
FIG. 10 is a detailed plan view of the temperature set point linkage of the variable air volume ceiling diffuser in the heating mode with the damper closed in accordance with the present invention.
Figure 11:
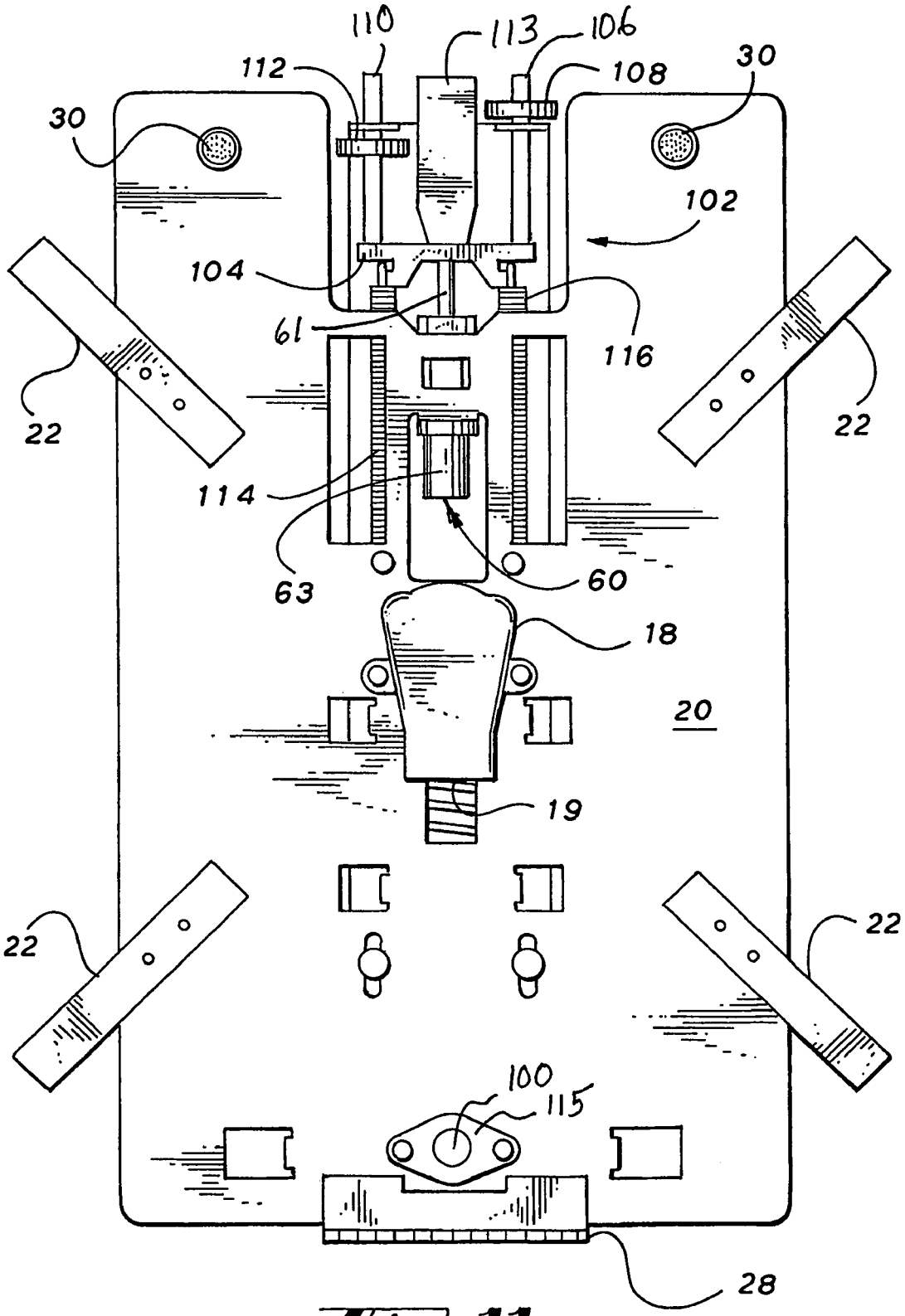
FIG. 11 is a bottom plan view of the variable air volume ceiling diffuser with a movable damper in accordance with the present invention.

With reference to FIGS. 7*a*, 7*b*, and 10, the first room temperature actuator 60 includes a first room temperature actuator body 63. The body 63 of the first room temperature actuator 60 is affixed to the base plate 20 by means of first room temperature actuator bracket 62. The second room temperature actuator 70 includes a second room temperature actuator body 73. The first room temperature actuator 60 and the second room temperature actuator 70 share a common piston 61. The body 73 of the second room temperature actuator 70 is slidably mounted on the common piston 61.

With reference to FIGS. 6*a*, 6*b*, 7*a*, 7*b*, and 10, a set point mechanism 102 is part of the damper control linkage 44 and comprises a slide activator bar 104, a threaded heating rod 110 with a heating set point knob 112, and a threaded cooling rod 106 with a cooling set point knob 108. The threaded heating rod 110 is connected to one end of the slide activator bar 104, and the threaded cooling rod 106 is connected to the other end of the slide activator bar 104. The slide activator bar 104 is connected to the body 73 of the second room temperature actuator 70. Room temperature bias springs 114 and 116 are connected to each end of the slide activator bar 104. The other ends of the bias springs 114 and 116 are connected to the base plate 20 by means of anchor posts 118 and 120. The bias springs 114 and 116 cause the common piston 61 to retract into both the first room temperature actuator body 63 and the second room temperature actuator body 73.

With reference to FIGS. 1, 3, 7*a*, and 7*b*, a room temperature actuator cover 38 is supported by the base plate 20 and extents over and around the first room temperature actuator 60 and the second room temperature actuator 70. The room temperature actuator cover 38 has a room temperature air inlet 40 in communication with the occupied space. As warm or cool air enters the upper opening 33 of the damper stack 32 under pressure, the air passes across the supply temperature actuator 46 and exits through the restricted discharge opening 19 of the converging deflector 18. As the air exits through the restricted discharge opening 19 of the converging deflector 18, the restricted discharged opening 19 creates a jet of air moving from right to left in FIGS. 7*a* and 7*b*. The jet creates low pressure at the inlet 40 of the actuator cover 38 thereby pulling room temperature air into the air inlet 40 and across the first room temperature actuator 60 and the second room temperature actuator 70.

With reference to FIGS. 6*a*, 6*b*, 7*a*, and 7*b*, the damper control linkage 44 further includes a heating mode slide 74, a cooling mode slide 80, a slide inverter mechanism 130, a cam actuator or roller 131, a cam lift profile 132, a lever mounting bracket 92, and lever arms 90 and 91 for rotation about a lever axis 94. A pair of lever bias springs 95 biases the levers 90 and 91 in a counterclockwise direction about the lever axis 94 (FIGS. 7*a* and 7*b*) tending to raise the damper 42 toward its upper closed position. Consequently, the lever bias springs 95 help to offset the weight of the damper 42. The mounting bracket 92 has bracket slots 96 (FIG. 3) which allowed the lever axis 94 to be raised and lowered with respect to the base plate 20. The lever axis 94 is raised and lowered by means of a minimum air adjustment mechanism 98 (FIG. 5). The minimum air adjustment mechanism 98 comprises a bushing 99 engaging the lever axis 94 and a minimum air adjustment screw 100 that threads into the adjustment bushing 99 and is captured by the base plate 20. By turning the minimum air adjustment screw 100, the adjustment bushing 99 and the lever axis 94 are raised or lowered in the bracket slots 96 with respect to the base plate 20.

Turning to FIGS. 3 and 7*a*, the heating mode slide 74 has a body portion 75 that extents along the length of the diffuser 10. The body portion 75 of the heating mode slide 74 has a generally inverted U-shaped cross-section with cutouts to accommodate, for example, the damper stack 32 and the dual set point mechanism 102. The heating mode slide 74 has a downwardly extending control tab 76 (FIGS. 3 and 10) with a hole adjacent the dual set point mechanism 102 that engages the threaded heating rod 110. The heating mode slide 74 also has a first inverter mechanism pivot 136 and a second inverter mechanism pivot 139 (left side of FIGS. 7*a* and 7*b*) and a downwardly extending stop tab 78 midway between the ends of the heating mode slide 74.

The cooling mode slide 80 has a body portion 81 that extents along the length of the diffuser 10. The body portion 81 of the cooling mode slide 80 has a generally inverted U-shaped cross-section with cutouts to accommodate, for example, the damper stack 32 and the dual set point mechanism 102. The cooling mode slide 80 has a downwardly extending control tab 82 (FIGS. 7*a*, 7*b*, and 10) with a hole adjacent the dual set point mechanism 102 (right side of FIGS. 7*a* and 7*b*) that engages the threaded heating rod 106. The cooling mode slide 80 also has a pair of horizontal slots 83 (FIG. 3, left side of FIGS. 7*a* and 7*b*) and a downwardly extending stop tab 84 midway between the ends of the cooling mode slide 80.

The heating mode slide 74 is nested within and underneath the cooling mode slide 80 so that the heating mode slide 74 and the cooling mode slide are free to slide with respect to each other and with respect to the base plate 20. The base plate 20 has heating base plate tabs 79 and cooling base plate tabs 85 (FIGS. 8*a*, 8*b*, 9*a*, and 9*b*). The heating base plate tabs 79 engage the heating mode slide stop tab 78 to arrest the movement of the heating mode slide 74 from moving to the right in FIGS. 6*a*, 6*b*, 7*a*, 7*b*, 8*a*, 8*b*, 9*a*, and 9*b*. The cooling base plate tabs 85 engage the cooling mode slide stop tab 84 to arrest the movement of the cooling mode slide 80 to the left in FIGS. 6*a*, 6*b*, 7*a*, 7*b*, 8*a*, 8*b*, 9*a*, and 9*b*.

Turning to FIGS. 8*a*, 8*b*, 9*a*, and 9*b*, the slide inverter mechanism 130 includes an inverter mechanism base 133 attached to the base plate 20 of the diffuser 10. The cam actuator or roller 131 is attached to an inverter mechanism slide 134 that is captured by the inverter mechanism base 133 and that is free to slide horizontally on the inverter mechanism base 133. The inverter mechanism slide 134 has a vertical slide post 135. The vertical slide post 135 is captured by a first lever slot 138 of a first inverter mechanism lever 137 and by a second lever slot 141 of a second inverter mechanism lever 140. The first inverter mechanism lever 137 pivots about the first inverter mechanism pivot 136, and the second inverter mechanism lever 140 pivots about the second inverter mechanism pivot 139. As previously disclosed, the first inverter mechanism pivot 136 and the second inverter mechanism pivot 139 are fixed to the heating mode slide 74. The cooling mode slide slot 83 on one side 145 of the cooling mode slide 80 captures an end 143 of the first inverter mechanism lever 137. Likewise, the cooling mode slide slot 83 on the opposite side 146 of the cooling mode slide 80 captures an end 144 of the second inverter mechanism lever 140.

Figure 6A:
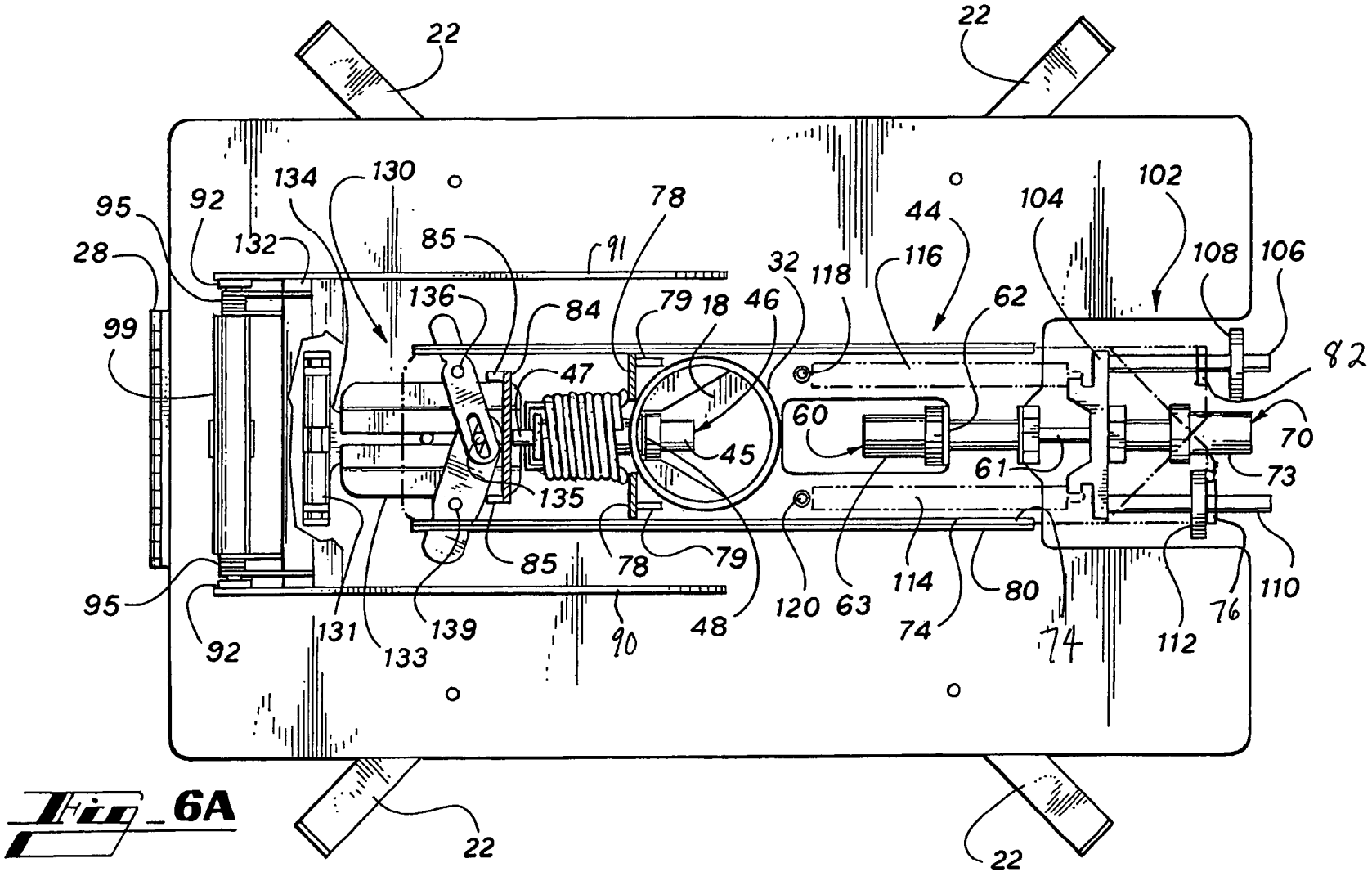
FIG. 6*a* is a plan view of the linkage of the variable air volume ceiling diffuser in the heating mode with the damper closed in accordance with the present invention.
Figure 6B:
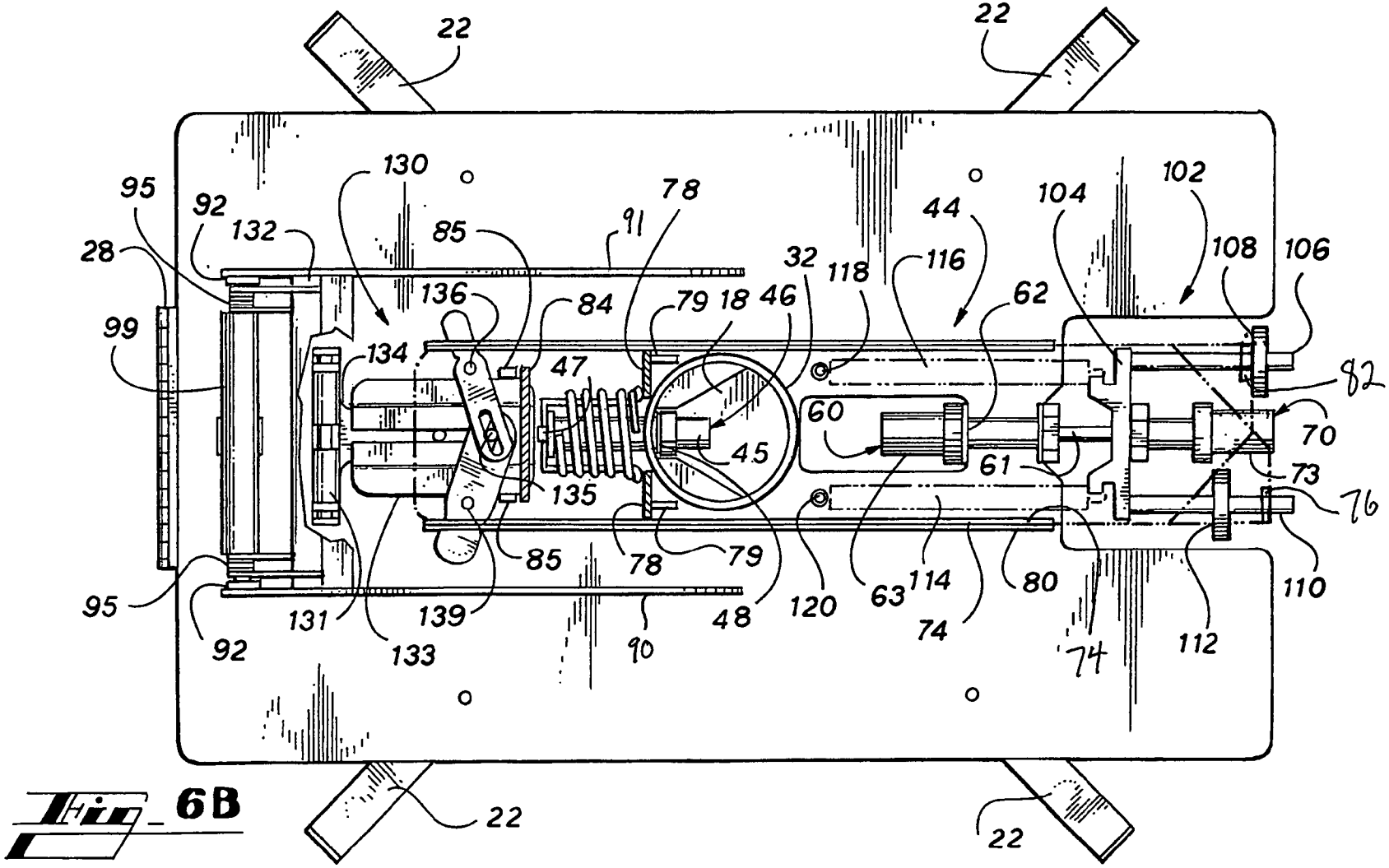
FIG. 6*b* is a plan view of the linkage of the variable air volume ceiling diffuser in the cooling mode with the damper closed in accordance with the present invention.
Figure 8A:
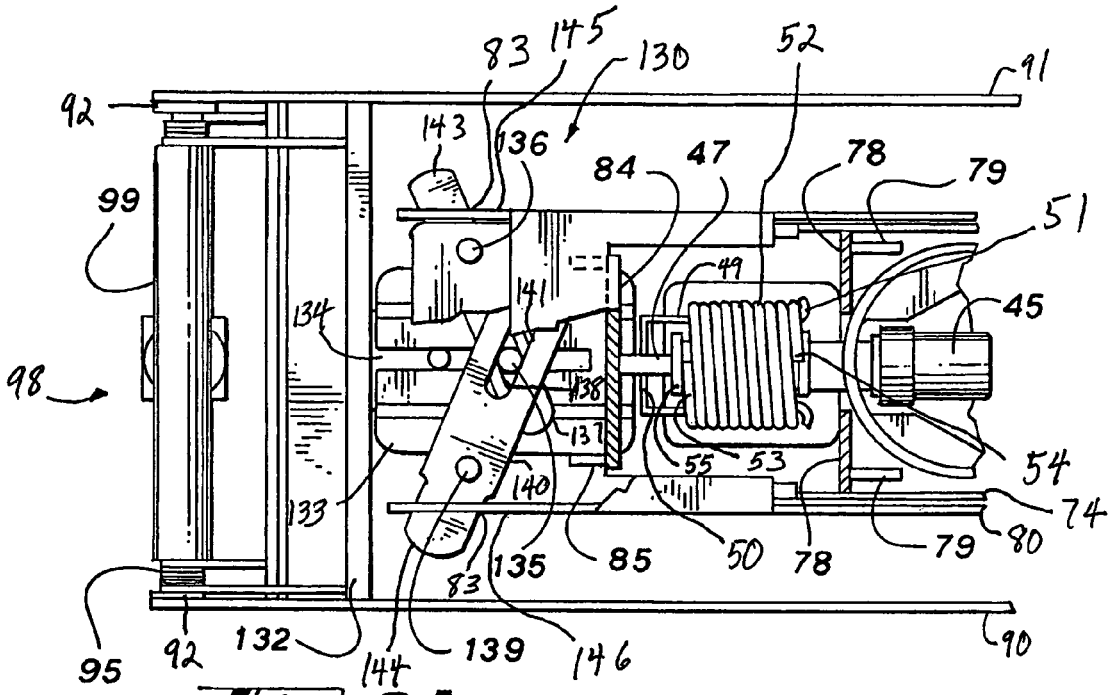
FIG. 8*a* is a detailed plan view of the linkage of the variable air volume ceiling diffuser in the heating mode with the damper closed in accordance with the present invention.
Figure 8B:
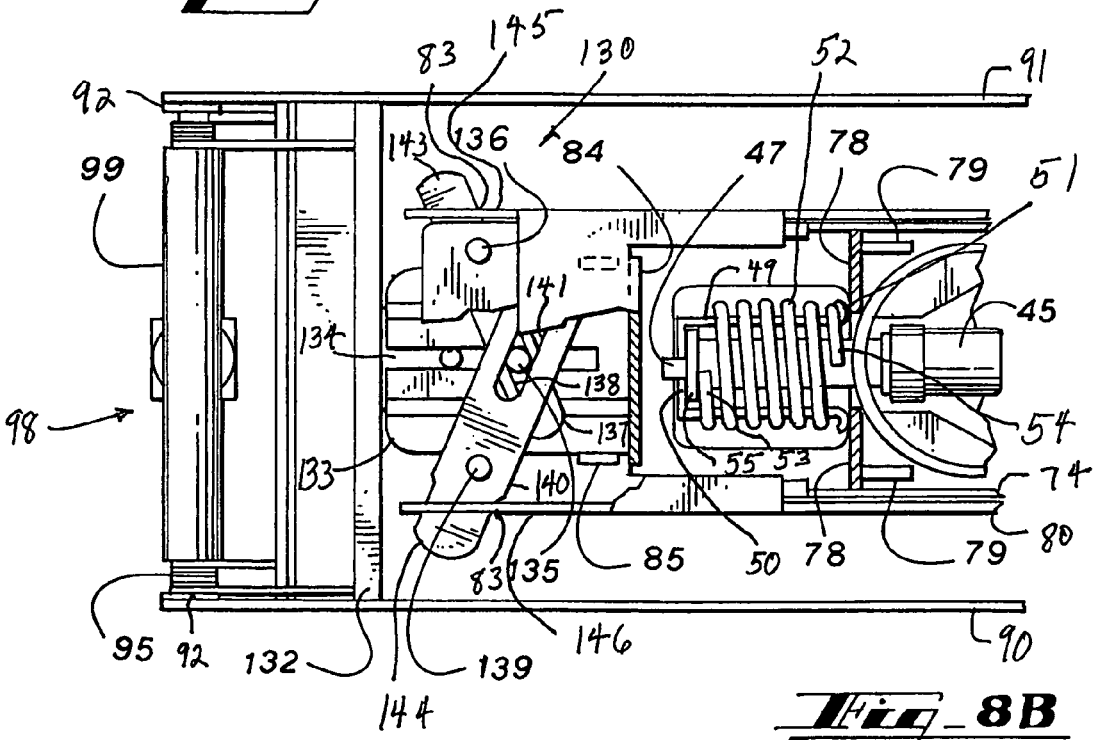
FIG. 8*b* is a detailed plan view of the linkage of the variable air volume ceiling diffuser in the cooling mode with the damper closed in accordance with the present invention.
Figure 9A:
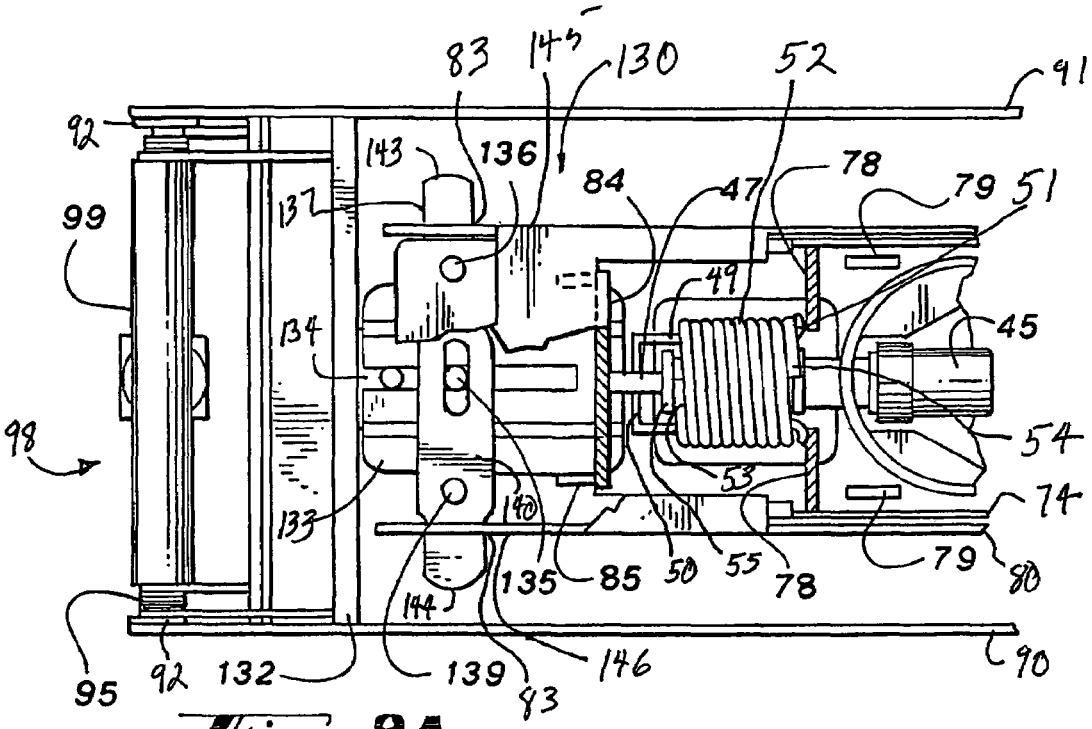
FIG. 9*a* is a detailed plan view of the linkage of the variable air volume ceiling diffuser in the heating mode with the damper open in accordance with the present invention.
Figure 9B:
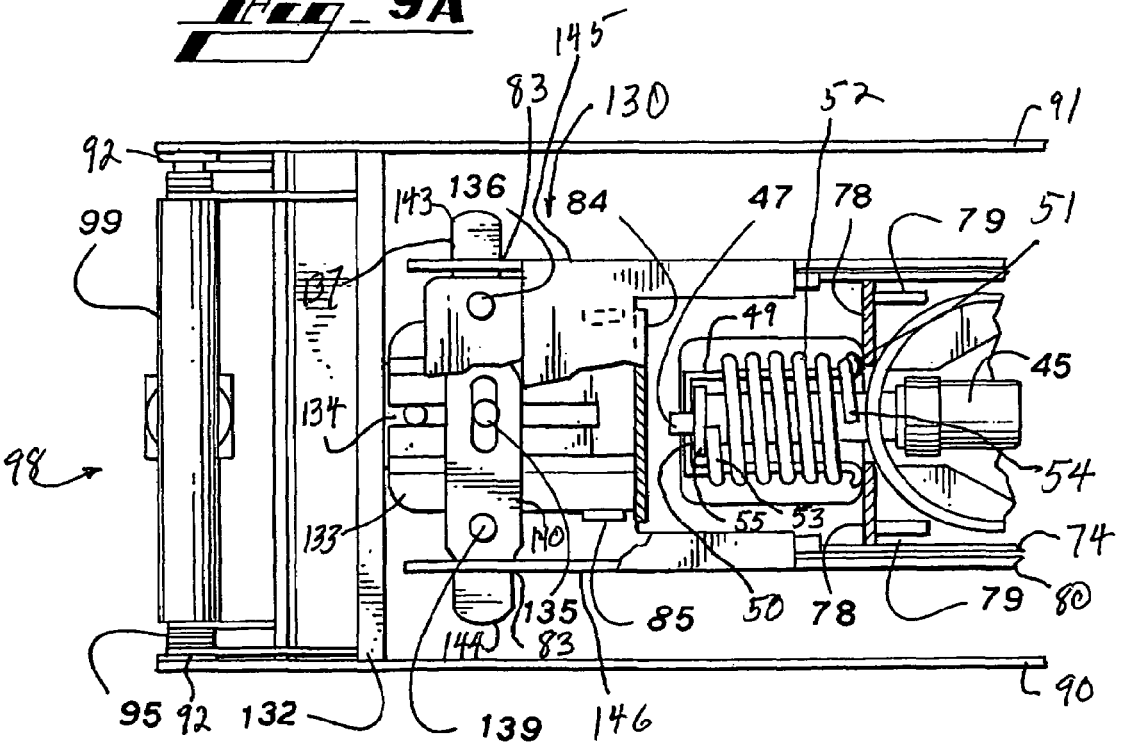
FIG. 9*b* is a detailed plan view of the linkage of the variable air volume ceiling diffuser in the cooling mode with the damper open in accordance with the present invention.

The heating mode operation of the diffuser 10 is illustrated with reference to FIGS. 6*a*, 7*a*, and 8*a* that show the diffuser 10 in the heating mode with the damper 42 closed, and the cooling mode operation of the diffuser 10 is illustrated with reference to FIGS. 6*b*, 7*b*, and 8*b* that show the diffuser 10 in the cooling mode with the damper 42 closed. FIG. 9*a* shows the diffuser 10 in the heating mode with the damper 42 open, and FIG. 9*b* shows the diffuser 10 in the cooling mode with the damper 42 open.

In the heating mode, warm air enters the upper damper stack opening 33 from the air inlet 14 of the diffuser 10. The warm air passes through the damper stack 32 and exits through the restricted discharge opening 19 thereby drawing room temperature air into the room air inlet 40 of the actuator cover 38 and across the first room temperature actuator 60 and the second room temperature actuator 70. If the duct air is warm and the room air is warm, the damper 42 is closed as shown in FIGS. 6*a*, 7*a*, and 8*a*. Specifically, the warm air inside the damper stack 32 impinges on the supply temperature actuator 46 and causes the supply temperature actuator piston 47 to extend against the resistance of the supply temperature bias spring 52. The extended supply temperature actuator piston 47 engages the cooling mode slide stop tab 84 and pins the cooling mode slide stop tab 84 against the cooling mode base plate tabs 85 on the base plate 20 thereby holding the cooling mode slide 80 in the leftward position shown in FIGS. 6*a*, 7*a*, and 8*a*.

Because the room temperature is warm, the common piston 61 of the first room temperature actuator 60 and the second temperature actuator 70 is extended from the first room temperature actuator body 63 and from the second room temperature actuator body 73. The extension of the common piston 61 forces the body 73 of the second room temperature actuator 70 to the right most position shown in FIGS. 6*a* and 7*a*. Because the slide activator bar 104 is attached to the body 73 of the second room temperature actuator 70, the slide activator bar 104 is positioned in the right most position shown in FIGS. 6*a* and 7*a*. As a result, the threaded cooling rod 106 and the threaded heating rod 110 are in the right most position as well. The heating knob 112 on the threaded heating rod 110 engages the heating mode slide control tab 76 so that the heating mode slide 74 is positioned toward the right in FIGS. 6*a* and 7*a*. With the heating mode slide 74 positioned toward the right, the first inverter mechanism lever 137 and the second inverter mechanism lever 140 are rotated as shown in FIG. 8*a*. In that position, the inverter mechanism levers 137 and 140 pull the slide post 135 toward the right. As a result, the cam roller 131 engages the cam lift profiled 132 at its rightward most position as shown in FIG. 7*a*. When of the cam roller 131 is in the rightward most position, the lever arms 90 and 91 are pivoted counterclockwise about the lever axis 94 to raise the damper 42 to its upper closed position.

As the temperature in the occupied space decreases, the cooler room temperature air is drawn into the inlet 40 of the actuator cover 38. The cooler room temperature air causes the common piston 61 to retract into both the first room temperature actuator 60 and the second room temperature actuator 70 as a result of the spring tension from bias springs 114 and 116. As the common piston 61 retracts, the body 73 of the second room temperature actuator 70 moves to the left (FIGS. 6*a*, 7*a*, and 8*a*) carrying with it the slide activator bar 104, the threaded cooling rod 106, and the threaded heating rod 110. As the threaded heating rod 110 moves left, the heating knob 112 also moves left allowing the heating mode slide 74 to move to the left under the influence of the force provided by the weight of the damper 42 transmitted through the lever arms 90 and 91, the cam lift profile 132, the cam roller 131, and the slide inverter mechanism 130. As the heating mode slide 74 moves left, the first inverter mechanism pivot 136 and the second inverter mechanism pivot 139 attached to the heating mode slide 74 also move to the left causing the first inverter mechanism lever 137 to rotate clockwise and the second inverter mechanism lever 140 to rotate counterclockwise. The rotation of the first inverter mechanism lever 137 and the second inverter mechanism lever 140 drives the cam roller 131 toward the left. As the cam roller 131 moves to the left, the lift profile 132 allows the lever arms 90 and 91 to rotate clockwise about the lever axis 94 thereby lowering the damper 42 to allow warm air to enter the occupied space below the diffuser 10 to raise the temperature in the occupied space. In the heating mode with the damper 42 open, the positioning of the first inverter mechanism lever 137, the second inverter mechanism lever 140, and the inverter mechanism slide 134 are shown in FIG. 9*a*.

In the cooling mode, cool air enters the upper damper stack opening 33 from the air inlet 14 of the diffuser 10. The cool air passes through the damper stack 32 and exits through the restricted discharge opening 19 thereby drawing room temperature air into the room air inlet 40 of the actuator cover 38 and across the first room temperature actuator 60 and the second room temperature actuator 70. If the duct air is cool and the room temperature air is cool, the damper 42 is closed as shown in FIGS. 6*b*, 7*b*, and 8*b*. Specifically, the cool air inside the damper stack 32 impinges on the supply temperature actuator 46 and causes the supply temperature actuator piston 47 to retract under the influence of the bias spring 52. As the supply temperature actuator piston 47 retracts, the right end 54 of the spring 52 and the right end 51 of the spring keeper 49 move to the right and pin the heating mode slide stop tab 78 against the heating base plate tab 79 thereby holding the heating mode slide 74 in the rightward position shown in FIGS. 6*b*, 7*b*, and 8*b*.

Because the room temperature is cool, the common piston 61 is retracted into the first room temperature actuator 60 and the second temperature actuator 70 as a result of the room temperature bias springs 114 and 116. The retraction of the common piston 61 causes the body 73 of the second room temperature actuator 70 to the left most position shown in FIGS. 6*b* and 7*b*. Because the slide activator bar 104 is attached to the body 73 of the second room temperature actuator 70, the slide activator bar 104 is positioned in the left most position shown in FIGS. 6*b* and 7*b*. As a result, the threaded cooling rod 106 and the threaded heating rod 110 are in the left most position as well. The cooling knob 108 on the threaded cooling rod 106 engages the cooling mode slide control tab 82 so that the cooling mode slide 80 is position toward the left in FIGS. 6*b* and 7*b*. With the cooling mode slide 80 positioned toward the left, the first inverter mechanism lever 137 and the second inverter mechanism lever 140 are rotated as shown in FIG. 8*b*. In that position, the inverter mechanism levers 137 and 140 pull the slide post 135 toward the right. As a result, the cam roller 131 engages the cam lift profiled 132 at its rightward most position as shown in FIG. 7*b*. When of the cam roller 131 is in the rightward most position, the lever arms 90 and 91 are pivoted counterclockwise about the lever axis 94 to raise the damper 42 to its upper closed position.

As the temperature in the room increases, the warmer room temperature air is drawn into the inlet 40 of the actuator cover 38. The warmer room temperature air causes the common piston 61 to extend from both the first room temperature actuator 60 and the second room temperature actuator 70 against the spring tension of bias springs 114 and 116. As the common piston 61 extents, the of body 73 of the second room temperature actuator 70 moves to the right (FIGS. 6*b*, 7*b*, and 8*b*) carrying with it the slide activator bar 104, the threaded cooling rod 106, and the threaded heating rod 110. As the threaded cooling rod 106 moves right, the cooling knob 108 also moves right allowing the cooling mode slide 80 to move to the right as a result of the force provided by the weight of the damper 42 transmitted through the lever arms 90 and 91, the cam lift profile 132, the cam roller 131, and the slide inverter mechanism 130. As the cooling mode slide 80 moves right, cooling mode slide slots 83 attached to the cooling mode slide 80 also move to the right causing the first inverter mechanism lever 137 to rotate clockwise and the second inverter mechanism lever 140 to rotate counterclockwise. The rotation of the first inverter mechanism lever 137 and the second inverter mechanism lever 140 drives the cam roller 131 toward the left. As the cam roller 131 moves to the left, the lift profile 132 allows the lever arms 90 and 91 to rotate clockwise thereby lowering the damper 42 to allow cool air to enter the occupied space below the diffuser 10. In the cooling mode with the damper 42 open, the positioning of the first inverter mechanism lever 137, the second inverter mechanism lever 140, and the inverter mechanism slide 134 are shown in FIG. 9*b*.

The engineered cam lift profile 132 allows the small differential horizontal motion of the heating mode slide 74 and the cooling mode slide 80 described above to be amplified and predictably converted into a vertical motion of the damper 42.

With reference to FIG. 10, the temperature in the occupied space is set in the heating mode by adjusting the heating knob 112 along the threaded heating rod 110. Similarly, the temperature in the occupied space is set in the cooling mode by adjusting the cooling knob 108 along the threaded cooling rod 106. Particularly, in the heating mode, moving the heating knob 112 toward the left in FIGS. 6*a*, 7*a*, 8*a*, and 10 increases the temperature in the occupied space. Similarly, in the cooling mode, moving the cooling knob 108 toward the right in FIGS. 6*b*, 7*b*, 8*b*, and 10 increases the temperature in the occupied space. Set point indices 113 (FIG. 11) may be provided adjacent the set point knobs 108 and 112 to aid in the adjustment of the set point knobs 108 and 112. The set point knobs 108 and 112 are accessible from the occupied space below the diffuser by simply opening the plaque 26.

In connection with the installation of the diffuser 10 as part of a complete HVAC system, the damper 42 is set to its fully open position in order to balance the HVAC system to which the diffuser 10 is connected. In order to set the damper 42 is set to its fully open position, the adjustment screw 100 (FIG. 5) is rotated in order to raise the lever axis 94 in the bracket slots 96 (FIG. 3). Visible indices 115 (FIG. 11) are provided around the head of the adjustment screw 100 in order to facilitate adjustment to the fully open position. The adjustment screw 100 in conjunction with the adjustment bushing 99 also controls the minimum air opening for the damper 42. Again, by adjusting the lever axis 94 up or down, the minimum airflow is set for the damper 42. Further, the indices 115 around the head of the adjustment screw 100 provide assistance in facilitating the adjustment of the minimum airflow for the damper 42. The airflow adjustment screw 100 is accessible from the occupied space below the diffuser by simply opening the plaque 26.

Figure 12:
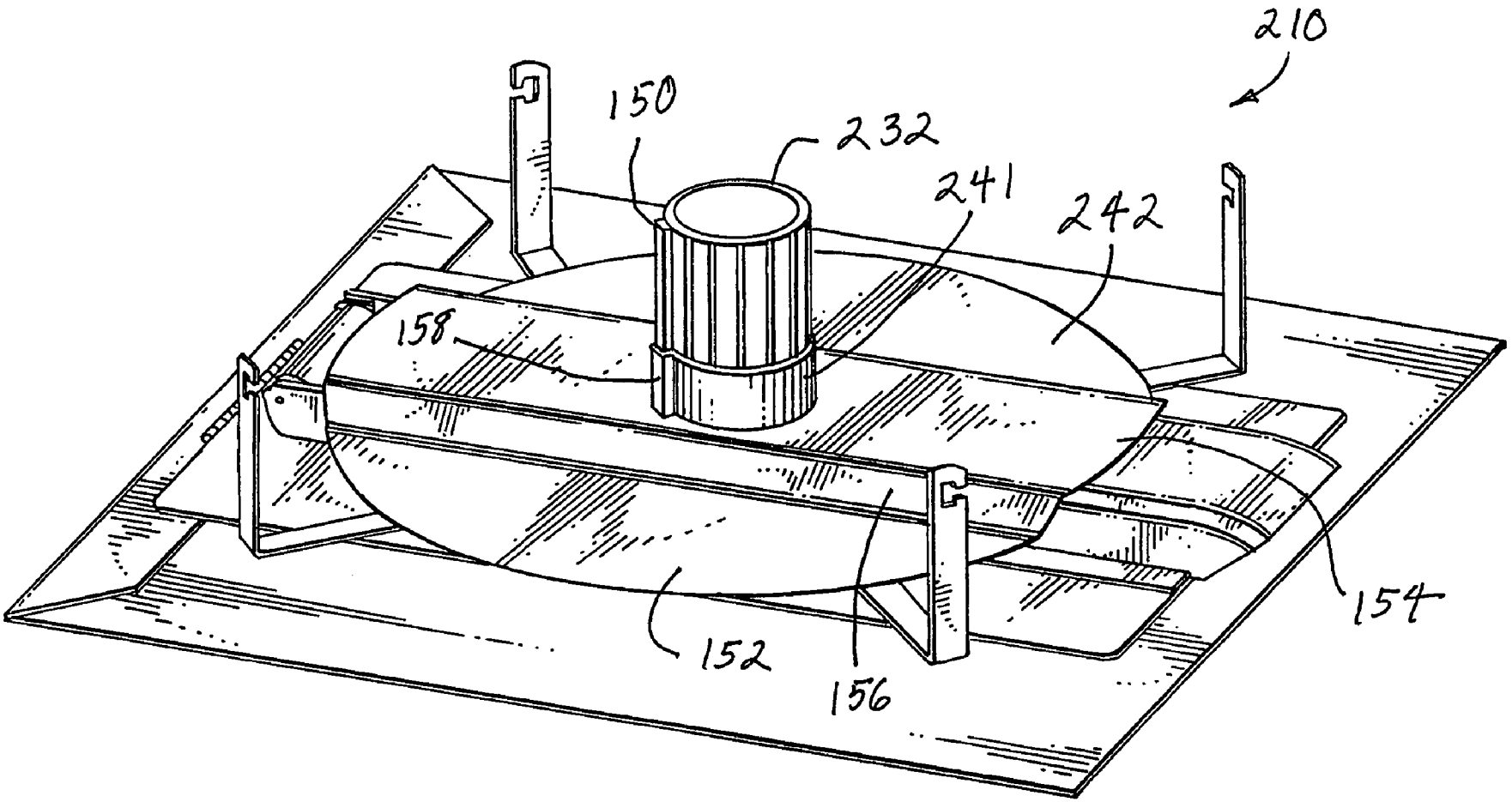
FIG. 12 is a perspective view of the variable air volume ceiling diffuser with a movable damper having a contoured profile in accordance with the present invention.
Figure 13:
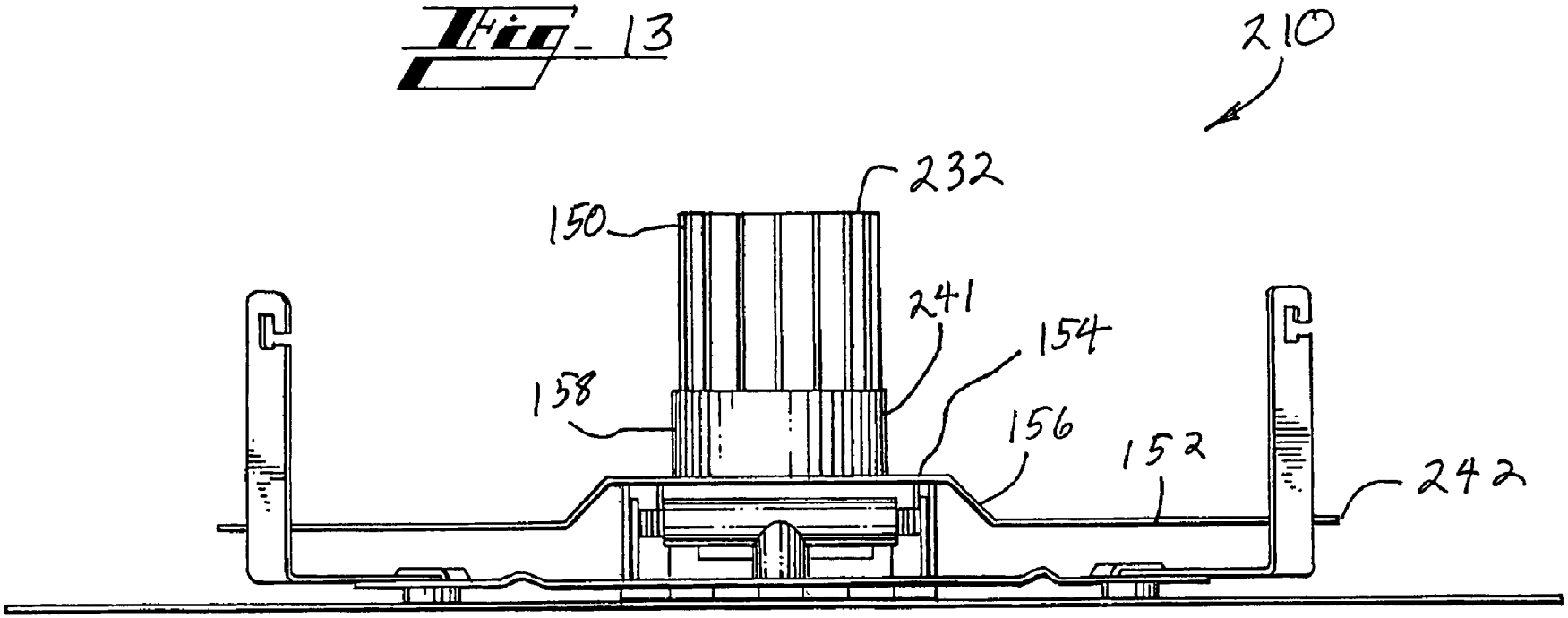
FIG. 13 is end elevation view of the variable air volume ceiling diffuser and showing the contoured damper profile in accordance with the present invention.

FIGS. 12 and 13 show an alternative embodiment of the ceiling diffuser 210 in accordance with the present invention. Particularly, the alternative embodiment has a profiled damper 242 having an upper section 154, a transition section 156, and a lower section 152. The profiled damper 242 has a damper bushing 241 that is slidably mounted on a modified damper stack 232. The modified damper stack 232 has splines 150 spaced about the outside circumference of the damper stack 232 and extending vertically along the outside of the damper stack 232. The splines engage matching recesses 158 on the damper bushing 241 so that the bushing 241 cannot be angularly displaced about the damper stack 232 as the damper 242 is raised and lowered. The profiled damper 242 minimizes noise when the damper 242 is in its fully opened position as shown in FIGS. 12 and 13.

While this invention has been described with reference to preferred embodiments thereof, it is to be understood that variations and modifications can be affected within the spirit and scope of the invention as described herein and as described in the appended claims.

We claim:

1. A ceiling diffuser comprising:

a. a diffuser hood with an air inlet for receiving warm or cool air from a duct and an air outlet for discharging the warm or cool air into an occupied space;

b. a base plate supported within the diffuser hood;

c. a damper stack extending between the base plate and the air inlet d. a damper movably mounted on the damper stack for opening and closing the air inlet;

e. a supply temperature actuator for sensing the temperature of the warm or cool air received from the duct f. a room temperature actuator for sensing the temperature in the occupied space;

g. a linkage for moving the damper on the damper stack to open and close the air inlet, wherein the linkage has a heating mode and a cooling mode that are selected by the supply temperature actuator and wherein the linkage includes:

i. a heating slide alternatively engaged by the room temperature actuator;

ii. a cooling slide alternatively engaged by the room temperature actuator;

iii. a cam actuator alternatively driven by the heating slide and the cooling slide;

iv. a cam lift profile driven by the cam actuator that engages the damper to move the damper to open and close the air inlet, wherein the supply temperature actuator selects the heating slide for engagement with the room temperature actuator for the heating mode and wherein the supply temperature actuator selects the cooling slide for engagement with the room temperature actuator for the cooling mode and wherein the heating slide and cooling slide are free to slide with respect to each other.

2. The diffuser of claim 1, wherein the diffuser has an actuator cover positioned about the room temperature actuator and wherein the damper stack has an air jet adjacent the base plate for directing the warm air or the cool air within the damper stack away from the room temperature actuator in order to drawing room temperature air across the room temperature actuator.

3. The diffuser of claim 1, wherein the damper stack has a circular cross-section and the damper has a circular opening that engages the circular cross-section of the stack so that the damper slides on the damper stack to open and close the air inlet and so that the damper is free to rotate about the damper stack.

4. The diffuser of claim 1, wherein the damper has a profile that requires a fixed angular orientation of the damper with respect to the damper stack, wherein the damper stack has a cross-section and the damper has an opening that engages the cross-section of the damper stack so that the damper slides on the damper stack to open and close the air inlet and so that the damper remains in a fixed angular rotate with respect to the damper stack.

5. The diffuser of claim 1, wherein the linkage further includes a lever that that rotates about a lever axis and engages the damper to move the damper and wherein the cam lift profile is connected to the lever for rotating the lever about the lever axis.

6. The diffuser of claim 5, wherein the linkage further includes an adjustment for moving the position of the lever axis to thereby set the minimum air flow for the diffuser.

7. The diffuser of claim 1, wherein the linkage includes a dual set point mechanism for interconnecting the slide to the room temperature actuator and includes a slide actuator bar that engages a cooling knob when the room temperature actuator moves in one direction and engages a heating knob when the room temperature actuator moves in the opposite direction.

8. The diffuser of claim 1, wherein the base plate has a plaque hinge on one side and a magnetic latch on the opposite side, wherein a plaque is attached to the hinge on the one side and held closed by the magnetic latch on the opposite side.

9. The diffuser of claim 1, wherein the room temperature actuator includes a first room temperature actuator for sensing the temperature in the occupied space and a second room temperature actuator for sensing the temperature in the occupied space and wherein the first room temperature actuator and the second room temperature actuator are interconnected.

10. The diffuser of claim 1, wherein the supply temperature actuator holds the cooling slide stationary with respect to the base plate in the heating mode and the supply temperature actuator holds the heating slide stationary with respect to the base plate in the cooling mode.

11. A ceiling diffuser comprising:

a. a diffuser hood with an air inlet for receiving warm or cool air from a duct and an air outlet for discharging the warm or cool air into an occupied space;

b. a base plate supported within the diffuser hood;

c. a damper stack extending between the base plate and the air inlet d. a damper movably mounted on the damper stack for opening and closing the air inlet;

e. a supply temperature actuator for sensing the temperature of the warm or cool air received from the duct f. a room temperature actuator for sensing the temperature in the occupied space;

g. a linkage for moving the damper on the damper stack to open and close the air inlet, wherein the linkage has a heating mode and a cooling mode that are selected by the supply temperature actuator and wherein the linkage includes:

i. a heating mode slide alternatively engaged by the room temperature actuator;

ii. a cooling mode slide alternatively engaged by the room temperature actuator;

iii. a cam actuator connected to the heating mode slide and the cooling mode slide and responsive to differential movement between that the heating mode slide and the cooling mode slide;

iv. a cam lift profile driven by the cam actuator that engages the damper to move the damper to open and close the air inlet wherein the supply temperature actuator selects the heating slide for engagement with the room temperature actuator for the heating mode and wherein the supply temperature actuator selects the cooling slide for engagement with the room temperature actuator for the cooling mode and wherein the heating slide and cooling slide are free to slide with respect to each other.

12. The diffuser of claim 11, wherein the diffuser has an actuator cover positioned about the room temperature actuator and wherein the damper stack has an air jet adjacent the base plate for directing the warm air or the cool air within the damper stack away from the room temperature actuator in order to drawing room temperature air across the room temperature actuator.

13. The diffuser of claim 11, wherein the damper stack has a circular cross-section and the damper has a circular opening that engages the circular cross-section of the stack so that the damper slides on the damper stack to open and close the air inlet and so that the damper is free to rotate about the damper stack.

14. The diffuser of claim 11, wherein the damper has a profile that requires a fixed angular orientation of the damper with respect to the damper stack, wherein the damper stack has a cross-section and the damper has an opening that engages the cross-section of the damper stack so that the damper slides on the damper stack to open and close the air inlet and so that the damper remains in a fixed angular rotate with respect to the damper stack.

15. The diffuser of claim 11, wherein the linkage further includes a lever that that rotates about a lever axis and engages the damper to move the damper and wherein the cam lift profile is connected to the lever for rotating the lever about the lever axis.

16. The diffuser of claim 15, wherein the linkage further includes an adjustment for moving the position of the lever axis to thereby set the minimum air flow for the diffuser.

17. The diffuser of claim 11, wherein the linkage includes a dual set point mechanism for interconnecting the heating mode slide and the cooling mode slide to the room temperature actuator and includes a slide actuator bar that engages a cooling knob when the room temperature actuator moves in one direction and engages a heating knob when the room temperature actuator moves in the opposite direction.

18. The diffuser of claim 11, wherein the base plate has a plaque hinge on one side and a magnetic latch on the opposite side, wherein a plaque is attached to the hinge on the one side and held closed by the magnetic latch on the opposite side.

19. The diffuser of claim 11, wherein the room temperature actuator includes a first room temperature actuator for sensing the temperature in the occupied space and a second room temperature actuator for sensing the temperature in the occupied space and wherein the first room temperature actuator and the second room temperature actuator are interconnected.

20. The diffuser of claim 11, wherein the supply temperature actuator holds the cooling slide stationary with respect to the base plate in the heating mode and the supply temperature actuator holds the heating slide stationary with respect to the base plate in the cooling mode.

* * * * *